US009062641B2

(12) United States Patent
Simon et al.

(10) Patent No.: US 9,062,641 B2
(45) Date of Patent: Jun. 23, 2015

(54) PLUG ASSEMBLY FOR HIGH-PRESSURE VALVE

(71) Applicant: DELPHI TECHNOLOGIES HOLDING, S.arl, Bascharage (LU)

(72) Inventors: Jerome Simon, Vineuil (FR); Christophe Breant, St. Sulpice de Pommeray (FR); Guillaume Priet, Blois (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 352 days.

(21) Appl. No.: 13/662,602

(22) Filed: Oct. 29, 2012

(65) Prior Publication Data

US 2013/0112289 A1 May 9, 2013

(30) Foreign Application Priority Data

Nov. 7, 2011 (FR) ..... 11 60070

(51) Int. Cl.
*F02M 63/00* (2006.01)
*F02M 51/06* (2006.01)

(52) U.S. Cl.
CPC ..... *F02M 51/06* (2013.01); *Y10T 29/49826* (2015.01); *F02M 63/0071* (2013.01); *F02M 2200/50* (2013.01); *F02M 2200/8084* (2013.01); *F02M 63/0075* (2013.01); *F02M 63/0017* (2013.01)

(58) Field of Classification Search
CPC ..... F02M 51/06; F02M 63/0075; F02M 63/0017; F02M 63/0071; F02M 2200/50; F02M 2200/8084; Y10T 29/49826
USPC ..... 251/337, 129.19, 129.06, 129.15; 123/188.1; 239/585.1–585.5, 533.3
See application file for complete search history.

(56) References Cited

U.S. PATENT DOCUMENTS

| | | | | |
|---|---|---|---|---|
| 2,630,139 | A * | 3/1953 | Nagel | 251/129.02 |
| 2,725,076 | A * | 11/1955 | Hansen et al. | 137/543.15 |
| 4,335,690 | A * | 6/1982 | Hosokawa et al. | 123/406.7 |
| 4,570,852 | A * | 2/1986 | Ohkata | 236/93 R |
| 5,360,197 | A * | 11/1994 | Reiter et al. | 251/129.21 |
| 7,871,251 | B2 * | 1/2011 | Marino et al. | 417/454 |
| 2003/0038269 | A1 * | 2/2003 | Creissel et al. | 251/337 |
| 2005/0189509 | A1 * | 9/2005 | Peric | 251/129.15 |
| 2009/0199820 | A1 | 8/2009 | Geyer | |
| 2010/0206252 | A1 | 8/2010 | Schroeder et al. | |

FOREIGN PATENT DOCUMENTS

| | | |
|---|---|---|
| DE | 102006020692 | 11/2007 |
| DE | 102007034038 | 1/2009 |

OTHER PUBLICATIONS

French Search Report dated May 31, 2012.

* cited by examiner

*Primary Examiner* — Marina Tietjen
(74) *Attorney, Agent, or Firm* — Thomas N. Twomey

(57) ABSTRACT

A plug assembly is provided for a high-pressure valve of the type with a tubular body extending along a longitudinal axis and in which, under the action of a piloted actuator, a needle moves longitudinally between a closed position and an open position. The plug assembly includes a plug having a flat part able to be fixed onto the body transversally to the longitudinal axis, and a spring intended to apply to the needle a force biasing it axially towards the closed position. The spring is fixed to the plug forming with it an integrated assembly.

17 Claims, 2 Drawing Sheets

PLUG ASSEMBLY FOR HIGH-PRESSURE VALVE

TECHNICAL FIELD

The invention relates to a high-pressure valve for a diesel injection circuit and more particularly to the process of assembling such a valve.

TECHNOLOGICAL BACKGROUND OF THE INVENTION

Circuits for direct fuel injection in internal combustion engines include a pilot operated valve which can be directly connected to a common rail distributing the pressurised fuel to injectors. The valve is normally closed and can be actuated to open a passage and allow egress of the fuel thus allowing the pressure in the injection circuit to be constantly controlled.

Valves are known inter alia comprising a tubular body in which a needle piloted by an electromagnetic actuator obturates or opens the fuel outlet passage. On the opposite side to the passage, a plug is welded to the body and closes it in sealed manner. In normal operation the passage is closed and its closure is ensured by the piloted actuator which applies a closing force to the needle opposing the opening force applied to the needle by the pressurised fuel. It has proved necessary to ensure the closure of the passage in case of malfunction of the actuator for any reason. A compression spring has therefore been arranged in the body, on the opposite side to the passage, the spring permanently acting between the plug and the needle applying to the latter a force for closure of the passage. The spring is calculated so that in case of malfunction of the actuator, the force applied by the spring is sufficient to overcome the opening force applied by the fuel, and thus the pressurised fuel continues to supply the injectors. Valves are known inter alia in which the needle is attached to the magnetic core of the actuator, the spring being compressed between the plug and the said core.

When the valves are assembled, the multiple components must be handled individually and placed in position one after the other. Inter alia, the assembly of the spring and the holding of it in place between the core, the body and the plug is a source of considerable difficulties and requires a large assembly cycle time.

It has become an urgent matter to facilitate the assembly of the valves and reduce the time necessary for it.

SUMMARY OF THE INVENTION

The present invention resolves the problem mentioned above by proposing a plug assembly for a high-pressure valve forming part of the common rail injection circuit of an internal combustion engine. The valve is of the type with a tubular body extending along a longitudinal axis and in which, under the action of a piloted actuator, a needle moves longitudinally between a closed position and an open position. The plug assembly comprises a plug having a flat part able to be fixed onto the body transversally to the longitudinal axis, and a spring intended to apply to the needle a force biasing it axially towards the closed position. Moreover, the spring is advantageously fixed to the plug forming with it an easily handled integrated assembly. In addition the plug includes an annular protuberance which extends axially from the flat part so as to form a bearing intended for longitudinal guidance of the needle. The spring is fixed onto the annular protuberance.

The spring is preferably of the helical type and the annular protuberance includes a first jamming section the external diameter of which is slightly greater than the internal diameter of the spring. Thus the spring is fixed by jamming of a turn of the spring around the jamming section. The jamming section is arranged at the base of the protuberance close to the flat part of the plug. The annular protuberance includes a second guiding section which extends beyond the jamming section and the external diameter of which is less than the internal diameter of the spring. Thus, during assembly, the second guiding section acts as a guide for the spring, without hampering the movements of the spring during compression and expansion phases.

The guiding section and the jamming section can be formed by a surface in the form of a truncated cone which has the advantage of facilitating the placing in position of the spring during assembly. The protuberance is formed in one piece with the plug.

Alternatively, the spring can be fixed to the plug by welding or sticking or any other means in particular using an intermediate piece such as a flange. This fixing method can be selected to replace or be added to the jamming method described above.

In addition, the plug is provided with a tubular jacket extending axially from the circumference of the flat part to a distal end. The plug is able to be fixed to the body at this distal end. Thus, the plug defines an internal space able to house and guide a movable part of the piloted actuator such as the magnetic core of an electromagnet.

The invention also relates to a high-pressure valve forming part of the common rail injection circuit of an internal combustion engine. The valve comprises a tubular body, a passage known as low-pressure, for the fuel being formed at a first end of the body. A needle is arranged axially in the body and is displaced under the action of a piloted actuator between an open position of the passage and a closed position of the passage, The valve comprises in addition a plug assembly in accordance with the description above. The plug is fixed to a second end of the body opposite to the first end and the spring is arranged between the plug and the needle and applies to the latter a force biasing it towards the closed position.

The invention lastly relates to a process for assembly of a high-pressure valve intended to be part of the common rail injection circuit of an internal combustion engine. The process comprises the following steps:

- providing a tubular body extending along a longitudinal axis, a passage being formed at one end of the body,
- providing a needle and a piloted actuator,
- providing a plug having a flat part able to be fixed onto the body transversally to the axis of the body, the plug being provided with a bearing intended to guide the needle along the longitudinal axis,
- providing a spring,
- arranging the needle and the piloted actuator in the body,
- fixing the spring to the plug so as to form an integrated plug assembly in accordance with the preceding description. This step of the process can advantageously be performed in parallel with the other steps which saves time. In addition the handling of the plug assembly is facilitated by means of this step of the process.
- arranging the plug assembly so that the spring applies a force to the needle,
- fixing the plug assembly to the body.

DESCRIPTION OF THE FIGURES

An embodiment of the invention is now described by means of the following figures.

DESCRIPTION OF THE PREFERRED EMBODIMENTS

Figure 1:
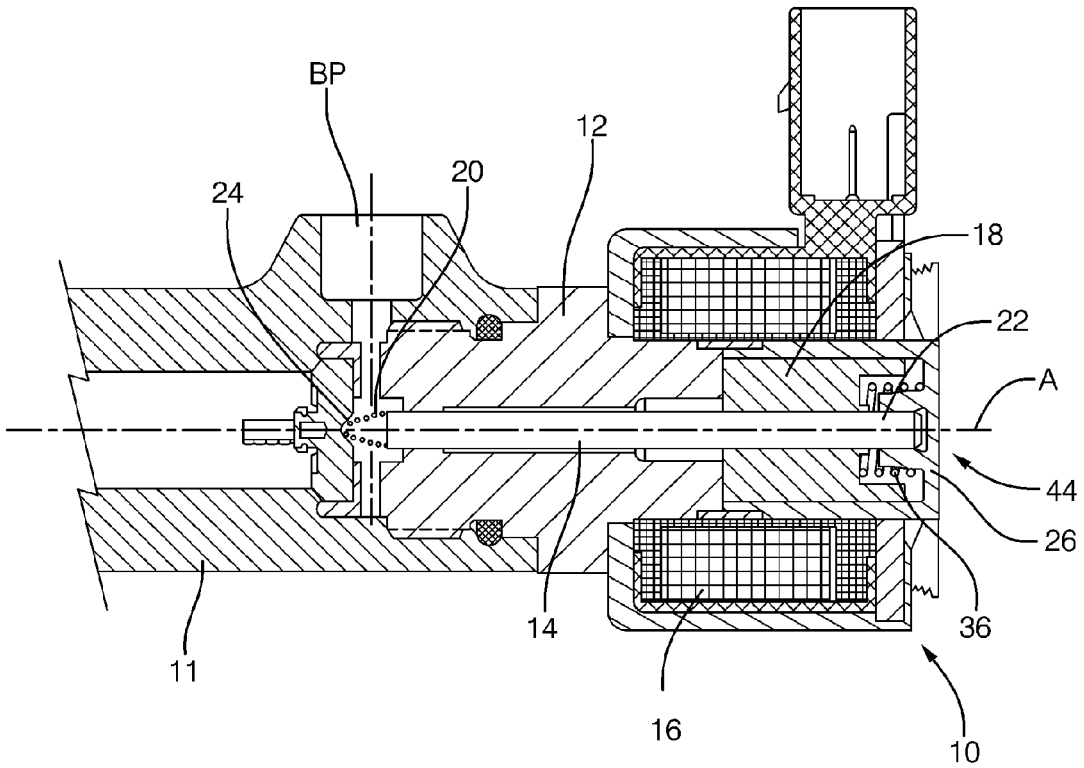
FIG. 1 is a view in axial section of a high-pressure valve in accordance with the invention.

FIG. 1 shows a valve 10 arranged at the end of the common rail 11 of a high-pressure direct injection circuit fitted to an internal combustion engine. The valve 10 comprises a cylindrical and tubular body 12 extending along a longitudinal axis A. A needle 14 is arranged in the body 12 and can be displaced in it along the longitudinal axis A. The displacements of the needle 14 are controlled by an electromagnetic actuator 16 the core 18 of which is attached to the needle 14. A weld, or any other permanent fixing means can be used to attach the needle 14 and the core 18 together. The needle 14 extends between a first end 20, here shown pointed and to the left in FIG. 1, and a second end 22 shown flat. The first end 20 cooperates with a seat 24 attached to the body 12, the seat 24 being provided with a central hole. When the actuator 16 forces the needle 14 so that the first end 20 is in circumferential contact with the seat 24, the fuel under high pressure circulates in the rail 11 towards the injectors not shown, the valve being in a closed state. Conversely when the actuator 16 causes the needle 14 to be displaced distancing the first end 20 from the seat 24, then the pressurised fuel in the rail 11 leaves the rail 11 through the central hole of the seat 24 and reaches a low-pressure outlet passage BP. The valve 10 has switched from the closed state to the open state. Many constructions exist to produce this cooperation between the needle 14 and the seat 24 for the closure of the valve 10. In particular the addition is known of a ball between the first end 20, the ball being of a sufficient diameter to plug the central hole of the seat 24 without passing it or jamming in it. It will be understood moreover that when the valve 10 is in the closed state the pressurised fuel in the rail 11 applies to the needle 14 a force which tends to repel it and open the low-pressure outlet BP. On the opposite side to the seat 24, on the side of the second end 22 of the needle 14, the body 12 is closed in sealed manner by a plug 26. The plug 26 is permanently fixed to the body 12. This fixing effected by welding can also be effected by other means. The plug 26 includes a flat part 27 the inner face 28 of which turned towards the body 12, which face is called the inner face 28, is transversal to the axis A of the body 12. At the centre of the inner face 28 axially extends a protuberance 30 provided with an outer face 32 and with a hollow housing the internal face of revolution 34 of which forms a bearing for guiding the second end 22 of the needle 14 which can slide in it along the longitudinal axis A.

As shown in the Figures, the plug 26 comprises a cylindrical jacket 29 which extends axially from the peripheral circumference of the flat part 27. The plug 26 is fixed to the body 12 by welding at the end of the jacket 29. Thus placed in position and fixed to the body 12, the plug 26 defines an internal volume in which the core 18 is housed and displaced axially. Alternatively to this construction of a plug provided with a jacket, the jacket can be associated with the body, the plug only comprising the flat part.

To ensure that in the case of malfunction of the actuator 16 the valve 10 remains in the closed state and the low-pressure outlet passage BP remains obturated by the first end 20 of the needle 14, a helical spring 36 is compressed between the inner face 28 of the plug 26 and the core 18 of the actuator 16. Thus arranged the spring 36 constantly applies to the needle 14, via the core 18, a closing force which biases the needle 14 so as to keep the valve 10 in the closed state. The spring 36 is so dimensioned that the closing force applied to the needle 14 is greater than the opening force applied to this same needle 14, but in the opposite direction to the closing force, by the pressurised fuel. The valve 10 is therefore kept in the closed state even in case of malfunction of the actuator 16.

In order to facilitate the assembly of the valve 10, the outer face 32 of the protuberance 30 includes a base section 38 situated at the junction with the inner face 28 and a guiding section 40. The base section 38 is cylindrical of revolution of a diameter slightly greater than the internal diameter of the last turn 42 of the spring 36. Conversely the guiding section 40 is of a diameter less than the internal diameter of the spring 36.

Thus, on assembly of the valve 10, the spring 36 is easily fixed to the plug 26 by firstly slipping it around the guiding section 40 until the last turn 42 is jammed around the base section 38. The plug 26 and the spring 36 thus form an integrated plug assembly 44 which is very easy to handle.

Figure 2:
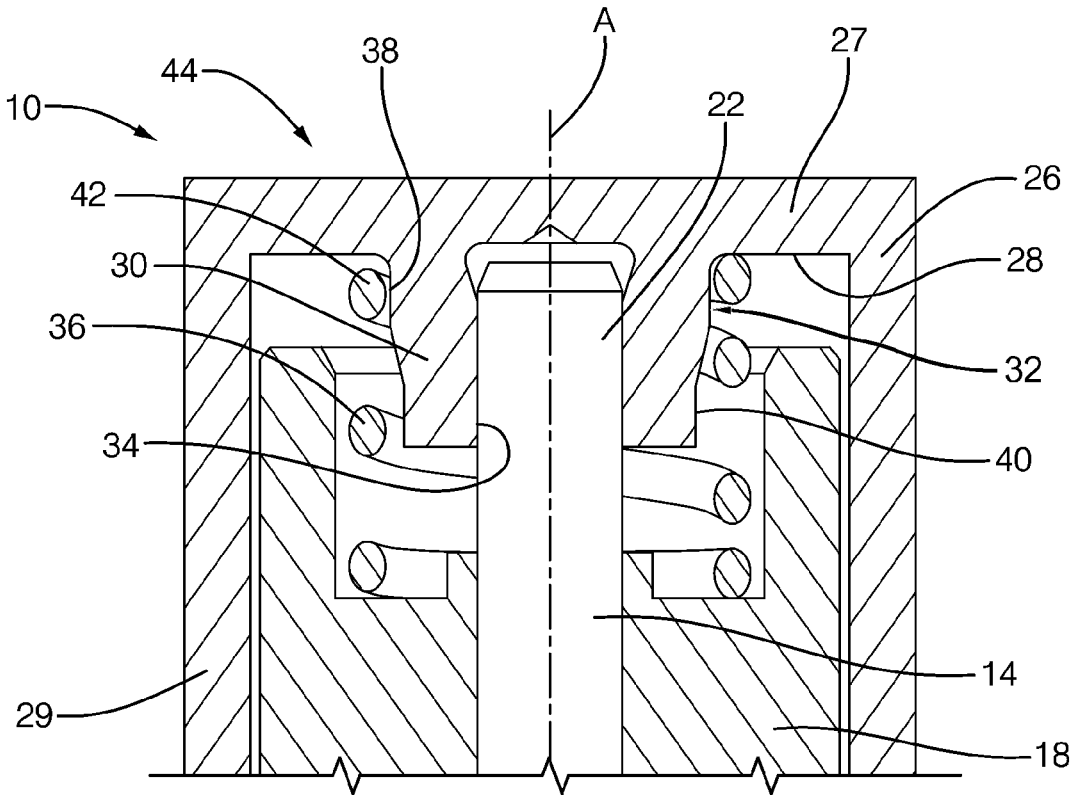
FIG. 2 is a detail of FIG. 1.

Many modified embodiments of the plug assembly 44 can be created by giving various methods of fixing the spring 36 to the plug 26. The base 38 and guiding 40 sections detailed in FIG. 2 are cylindrical of revolution and joined one to the other by an intermediate surface in the form of a truncated cone. They could also only form a single surface slightly in the form of a truncated cone, wider at the base than at the top. Also the protuberance 30 could have no guiding section and only comprise a base section 38 for jamming the spring 36. The protuberance 30 shown here and described as being of complete revolution could be formed of a plurality of separate sections together forming the guiding bearing and the jamming base.

The jamming and guiding of the spring 36 have been described as interior to the spring. A plug 26 could be envisaged not provided with a protuberance but with a hollow housing in which the spring jams by its external diameter, the guiding, if it is present being able to be interior or exterior to the spring.

Lastly, fixing of the spring 36 by means of welding or sticking could also be envisaged.

The invention claimed is:

1. A plug assembly for a high-pressure valve forming part of a common rail injection circuit of an internal combustion engine, the valve being of the type with a tubular body extending along a longitudinal axis and in which, under the action of a piloted actuator, a needle moves longitudinally between a closed position and an open position, the plug assembly comprising:

a plug having a flat part able to be fixed onto the tubular body transversally to the longitudinal axis, and a spring applying a force to the needle to bias the needle axially towards the closed position, wherein the spring is fixed to the plug forming with it an integrated assembly, and wherein the plug includes an annular protuberance which extends axially from the flat part so as to form a bearing for guiding the needle longitudinally, the spring being fixed onto the annular protuberance.

2. A plug assembly as described in claim 1 in which the spring is of the helical type and in which the annular protuberance includes a jamming section having an external diameter which is slightly greater than an internal diameter of the spring so that the spring is fixed by jamming of a turn of the spring around the jamming section.

3. A plug assembly as described in claim 2 in which the jamming section is arranged at a base of the annular protuberance close to the flat part of the plug, the annular protuberance including a guiding section which extends beyond the jamming section and the external diameter of which is less than the internal diameter of the spring so as to act, during assembly, as a guide for the spring without hampering the movements of the spring during compression and expansion phases.

4. A plug assembly as described in claim 3 in which the guiding section and the jamming section are joined by a surface in the form of a truncated cone.

5. A plug assembly as described in claim 1 in which the protuberance is formed in one piece with the plug.

6. A plug assembly as described claim 1 in which the spring is fixed to the plug by welding or sticking.

7. A plug assembly for a high-pressure valve forming part of a common rail injection circuit of an internal combustion engine, the valve being of the type with a tubular body extending along a longitudinal axis and in which, under the action of a piloted actuator, a needle moves longitudinally between a closed position and an open position, the plug assembly comprising:

a plug having a flat part able to be fixed onto the tubular body transversally to the longitudinal axis, and a spring applying a force to the needle to bias the needle axially towards the closed position, wherein the spring is fixed to the plug forming with it an integrated assembly, and wherein the plug is provided with a tubular jacket extending axially from the circumference of the flat part to a distal end, the plug being able to be fixed to the tubular body at the distal end so that the plug defines an internal space which houses and guides a movable part of the piloted actuator.

8. A process for assembly of a high-pressure valve of a common rail injection circuit of an internal combustion engine, the process comprising the following steps:

providing a tubular body extending along a longitudinal axis, a passage being formed at one end of the tubular body, providing a needle and a piloted actuator, providing a plug having a flat part able to be fixed onto the tubular body transversally to the axis of the tubular body, the plug being provided with a bearing to guide the needle along the longitudinal axis, providing a spring, arranging the needle and the piloted actuator in the tubular body, fixing the spring to the plug so as to form an integrated plug assembly, arranging the plug assembly so that the spring applies a force to the needle, fixing the plug assembly to the tubular body.

9. A process for assembly of a high-pressure valve as described in claim 8 in which the plug includes an annular protuberance which extends axially from the flat part, wherein the step of fixing the spring to the plug includes fixing the spring to the annular protuberance.

10. A process for assembly of a high-pressure valve as described in claim 9 in which the spring is of the helical type and in which the annular protuberance includes a jamming section having an external diameter which is slightly greater than an internal diameter of the spring, wherein the step of fixing the spring to the annular protuberance includes jamming a turn_of the spring around the jamming section.

11. A high-pressure valve forming part of a common rail injection circuit of an internal combustion engine, the valve comprising:

a tubular body extending along a longitudinal axis and having, a passage for the fuel being formed at a first end of the tubular body, a needle arranged axially in the tubular body and being displaced under the action of a piloted actuator between an open position of the passage and a closed position of the passage, and a plug assembly fixed to a second end of the tubular body opposite to the first end, the plug assembly comprising:

a plug having a flat part fixed onto the tubular body transversally to the longitudinal axis, and a spring applying a force to the needle to bias the needle axially towards the closed position, wherein the spring is fixed to the plug forming with it an integrated assembly, and wherein the plug includes an annular protuberance which extends axially from the flat part so as to form a bearing for guiding the needle longitudinally, the spring being fixed onto the annular protuberance.

12. A high-pressure valve as described in claim 11 in which the spring is of the helical type and in which the annular protuberance includes a jamming section having an external diameter which is slightly greater than an internal diameter of the spring so that the spring is fixed by jamming of a turn of the spring around the jamming section.

13. A high-pressure valve as described in claim 12 in which the jamming section is arranged at a base of the annular protuberance close to the flat part of the plug, the annular protuberance including a guiding section which extends beyond the jamming section and the external diameter of which is less than the internal diameter of the spring so as to act, during assembly, as a guide for the spring without hampering the movements of the spring during compression and expansion phases.

14. A high-pressure valve as described in claim 13 in which the guiding section and the jamming section are joined by a surface in the form of a truncated cone.

15. A plug assembly as described in claim 11 in which the annular protuberance is formed in one piece with the plug.

16. A plug assembly as described claim 11 in which the spring is fixed to the plug by welding or sticking.

17. A high-pressure valve forming part of a common rail injection circuit of an internal combustion engine, the valve comprising:

a tubular body extending along a longitudinal axis and having, a passage for the fuel being formed at a first end of the tubular body, a needle arranged axially in the tubular body and being displaced under the action of a piloted actuator between an open position of the passage and a closed position of the passage, and a plug assembly fixed to a second end of the tubular body opposite to the first end, the plug assembly comprising:

a plug having a flat part fixed onto the tubular body transversally to the longitudinal axis, and a spring applying a force to the needle to bias the needle axially towards the closed position, wherein the spring is fixed to the plug forming with it an integrated assembly, and wherein the plug is provided with a tubular jacket extending axially from a the circumference of the flat part to a distal end, the plug being able to be fixed to the tubular body at the distal end so that the plug defines an internal space which houses and guides a movable part of the piloted actuator.

* * * * *